US005086200A

United States Patent [19]

Kline et al.

[11] Patent Number: 5,086,200

[45] Date of Patent: Feb. 4, 1992

[54] MOLDED PRINTED CIRCUIT FOR ROTARY SWITCHES

[75] Inventors: Charles E. Kline, Sunrise; Dale W. Dorinski, Coral Springs; William M. Bradford, Davie, all of Fla.

[73] Assignee: Motorola, Inc., Schaumburg, Ill.

[21] Appl. No.: 532,784

[22] Filed: Jun. 4, 1990

[51] Int. Cl.[5] ..... H01H 19/20; H01H 9/00

[52] U.S. Cl. ..... 200/571; 200/11 R; 200/291

[58] Field of Search ..... 200/11 R, 11 D, 11 DA, 200/11 G, 11 K, 291, 564, 565, 570, 571; 361/397, 402

[56] References Cited

U.S. PATENT DOCUMENTS 3,346,708 10/1967 Marra ..... 200/565
3,588,393 2/1969 Hukee ..... 200/11 R
3,767,880 10/1973 Austin ..... 200/318
4,439,654 3/1984 Bresin et al. ..... 200/302.1
4,551,587 11/1985 Rose ..... 200/11 R
4,822,960 4/1989 Assum et al. ..... 200/11 R

*Primary Examiner*—Henry J. Recla
*Assistant Examiner*—David J. Walzak
*Attorney, Agent, or Firm*—Michael J. Buchenhorner

[57] ABSTRACT

A rotary switch, having at least two operating positions, includes a molded base with a printed electric circuit plated on at least one surface of the base, and at least one detent for providing the operating positions for the rotary switch. The detents also provided at least one electrical contact. A rotating contact member is rotatably attached to the base. The rotating contact member includes at least one electrical contact formed thereon for providing at least one connection with the printed electric circuit as the rotating contact member rotates.

14 Claims, 4 Drawing Sheets

MOLDED PRINTED CIRCUIT FOR ROTARY SWITCHES

TECHNICAL FIELD

This invention relates generally to radios having rotary switches, and more particularly to molded printed circuit board assemblies for rotary switches.

BACKGROUND

Conventional switches are complex mechanical assemblies that must be either mechanically attached or soldered to the required circuitry. Such switches use complex mechanical wipers, springs, balls, and levers to accomplish a required contacting scheme, which is internal to these switches. In addition, electrical connections to circuitry external to the switches are made through leads extending outward (either radially or axially) from the body of the switches. All known switches are made to be used as stand-alone components (i.e., they are made to perform as a fully-functioning part that is added to the circuitry at assembly. Those switches are difficult, if not impossible, to seal against dust or moisture, and are not easily modified, due to the large tooling costs (contemporaneously) associated with manufacturing complex mechanical devices.

SUMMARY OF THE INVENTION

Accordingly, it is an object of the present invention to overcome the detriments of the prior art.

Briefly, according to the invention, a rotary switch comprises a molded base having a printed circuit plated on one of its sides. The rotary switch also comprises a rotating contact member that has at least one electrical contact formed thereon for making contact with the printed circuit on the base. The molded base also includes one or more detents for providing the operating positions of the rotary switch.

DETAILED DESCRIPTION OF THE PREFERRED EMBODIMENT

Figure 1:
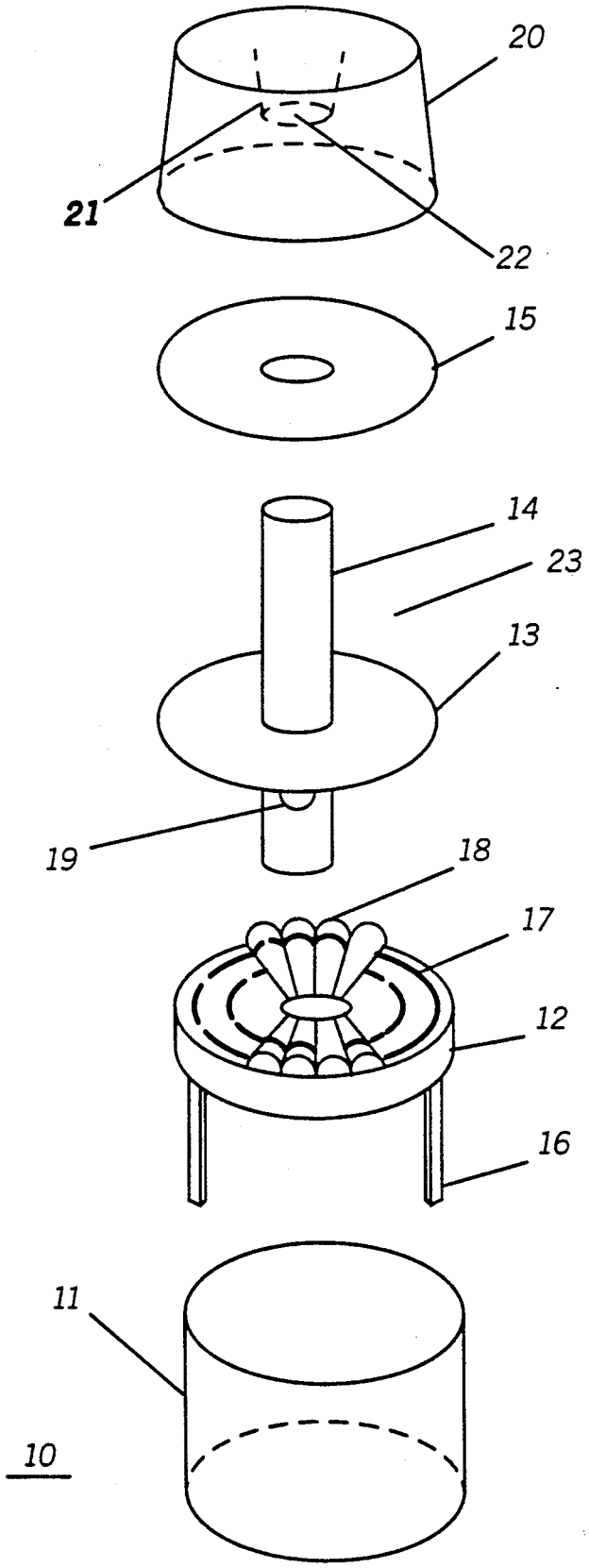
FIG. 1 is an exploded view of a rotary switch in accordance with the invention.

Referring to FIG. 1, a rotary switch 10 in accordance with the invention is shown. A switch housing 11 is attached to a switch cover 15 for containing the switch mechanism. A molded printed circuit base (or washer) 12 is placed into the switch housing 11. The housing 11 should be designed such that the washer 12 is interchangeable for different versions of the switch (i.e., for a different number of detents or a change in the circuitry).

A rotating contact member 23 comprises a contact finger plate 13 and a switch shaft 14 (which may be further combined into one part). These parts follow in assembly with the switch cover 15 as the last component. The switch cover serves as both a switch seal and a backing plate for the contact finger plate 13. The operating positions of the switch 10 are set by a mechanical detent mechanism that has a first portion (e.g., convex dimples) and a second portion (e.g., concave grooves for receiving the dimples). The washer 12 has detent features and electric circuitry 17 molded directly into it. The circuit traces should preferably be located on the lower portion of the detent groove to reduce wear. When a user turns the shaft 14 of the switch (usually by means of a knob 20), this causes the contact finger plate 13 to sweep across the detent washer 12 and selectively short or open circuitry within the washer 12, which can then be implemented by an integrated circuit or other electric circuit via output from the switch leads 16. The contact finger plate 13 is an electrically continuous member with projections (or detents) 19 (one shown) formed in it, such that they may deflect as they ride over the washer's 12 detent features. The number and depth of the 19 on the plate depend on the electric circuit requiring shorting on the washer 12 and the desired amount of detent force.

A knob 20 fits over the internal switch assembly described above. The knob 20 includes a cylindrical member 21 having a receptacle 22. The shaft 14 fits closely into the receptacle 22, so that a user may rotate the shaft 14 by twisting the knob 20.

Figure 2:
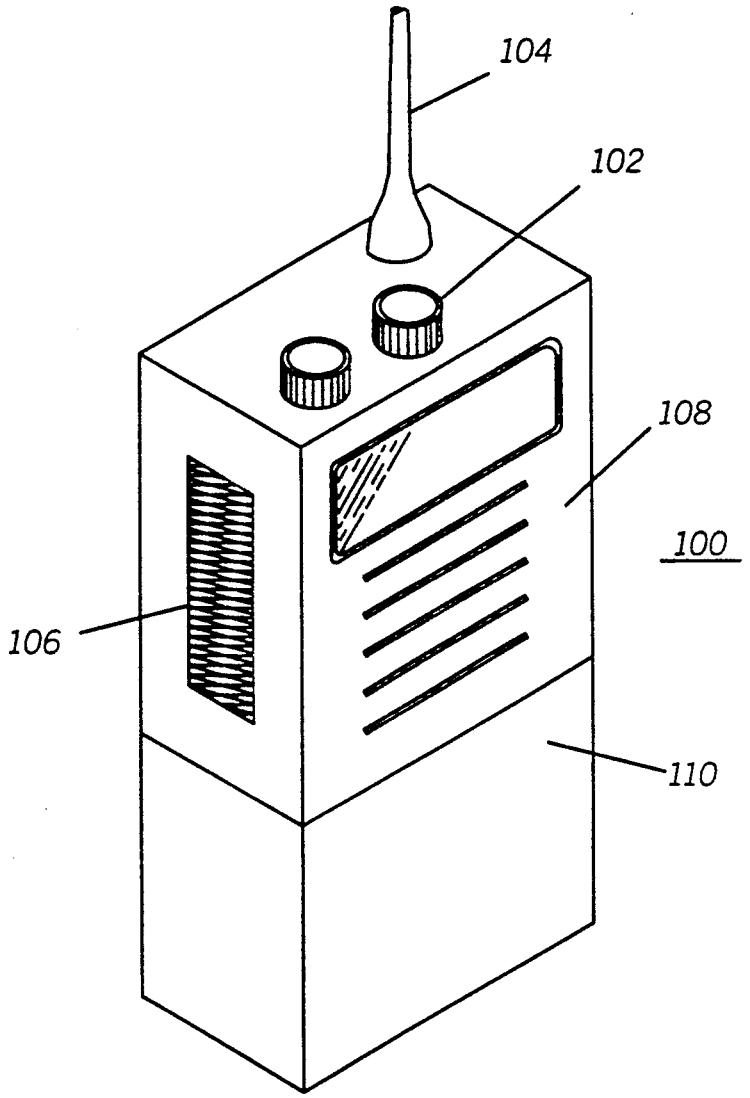
FIG. 2 is an elevational view, in perspective, of a portable radio apparatus of the type in which the present invention may be advantageously used.

Referring to FIG. 2, there is shown a portable radio 100 which may be considered typical of the type of apparatus in which the invention may be advantageously used. The radio 100 includes a housing 108 for containing electronic circuitry (not shown) suitable for transmitting and receiving functions, as well as a self contained power supply 110. The radio 100 includes a switch 102 in accordance with the invention, which may be used for effecting the necessary control functions. An antenna 104 (e.g., of a telescopic rod type) may extend upwardly from the top. A push-to-talk switch 106 is customarily provided on a side panel of the radio 100, for activating the radio's transmitter circuitry.

Figure 3:
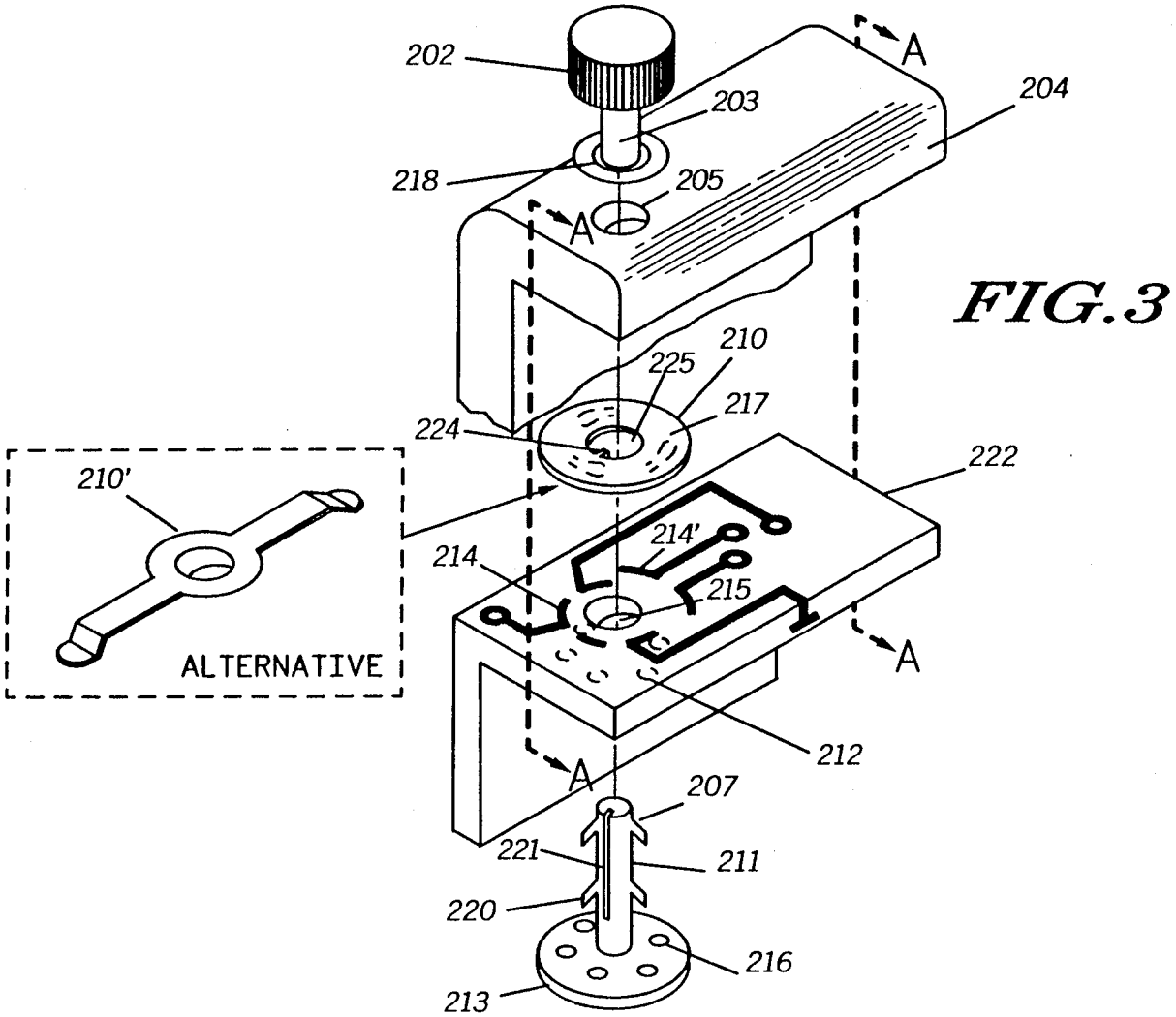
FIG. 3 is an exploded view of another rotary switch in accordance with the invention.

Referring to FIG. 3, an exploded view of another switch in accordance with the invention is shown. A knob 202 fits rotatably into an opening 205 in an escutcheon plate 204 (i.e. so that the knob 202 may rotate freely with respect to the escutcheon plate 204). An O-ring 218 fits around the shaft portion 203 of the knob 202, to provide a weather-resistant seal.

A shaft 211 having a base portion 213 and a keying feature 221 fits into a similarly keyed cylindrical hole 225 in the contact member 210. The shaft 211 has a plurality of snapping protrusions 220 extending radially therefrom to fit over the contact member 210, capturing the chassis 222 between the contact member 210 and the shaft base 213. The base 213 includes a plurality of detent bumps (or dimples) 216, that fit into recesses 212 in the printed circuit board chassis 222.

The printed circuit board chassis 222 contains metallizations 214 (on at least one of its surfaces) for forming an electrical circuit (or circuits). Thus, as the moving contact member 210 turns, the metallizations 217 in the contact member 210 may short different portions of the metallization 214 together to complete electric circuits.

The knob shaft 203 has an internally keyed hole 209 and a plurality of recesses 223 (refer to FIG. 4) that snap features 207 on the shaft 211 fit into, constraining the knob vertically and rotatably with respect to the shaft 211. This allows the contact plate 210 to turn as the knob 202 turns without rigid attachment or intimate contact between themselves.

Figure 4:
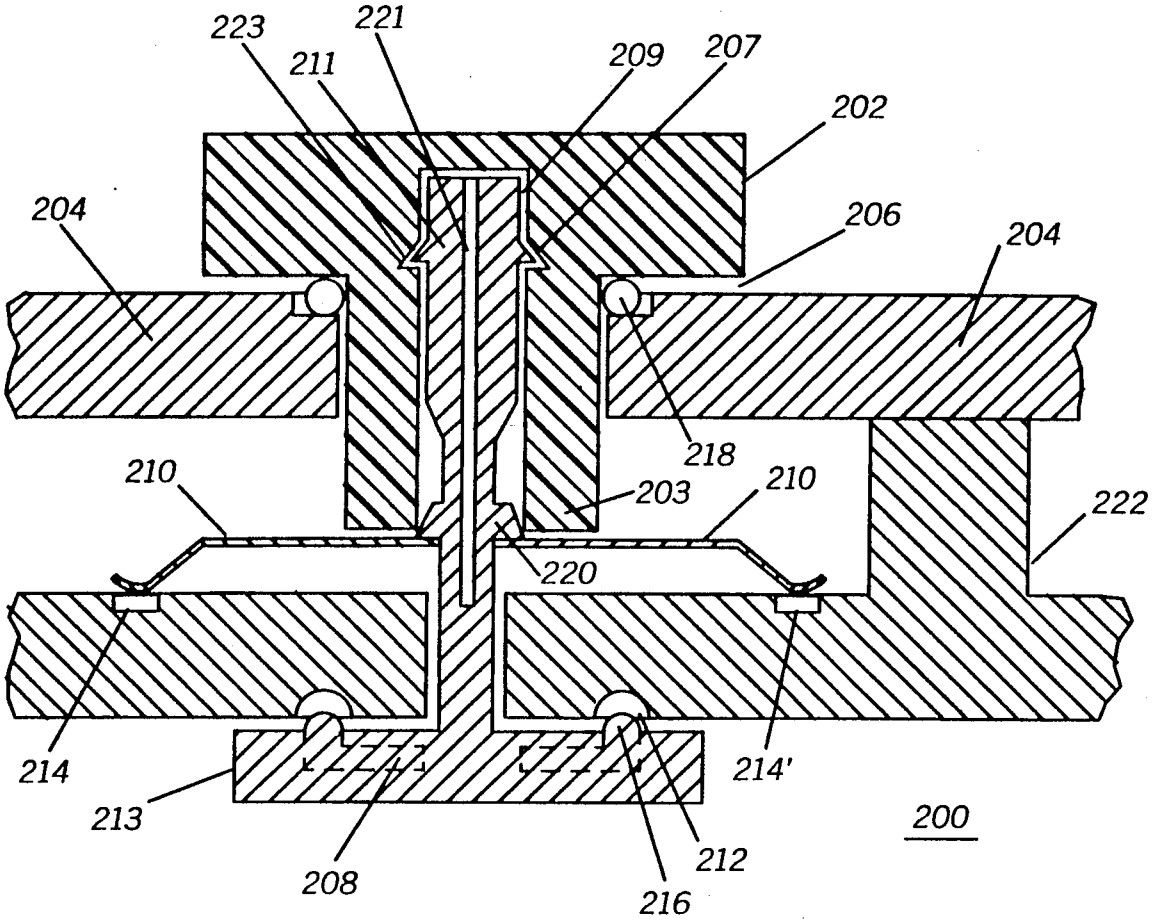
FIG. 4 is a cross-section (along section A) of the rotary switch shown in FIG. 3.

Referring to FIG. 4, there is shown a cross section of a switch 200 in accordance with the invention. The switch 200 incorporates one element of the switch contact (metallizations 214 and 214'), mechanical detents 212, and a shaft 211 which protrudes through a molded circuit base (or board) 222. Stationary contacts 214 and 214' are molded into the circuit board 222 during manufacture, using one of several existing processes. These contacts can be simply a conductor, resistive elements (to form a potentiometer), or any combination of those. Mechanical detents 212 are formed into one side of the molded board 222 and can consist of a series of recesses corresponding to each position where a detent 212 is desired. The switch shaft 211 is then inserted from the under side of the circuit board 222 through a hole 215 sized to allow unconstrained rotation of the shaft 211 relative to the chassis 222. The shaft 211 is held in place by a snap fitting 220 at the lower portion of the shaft 211 overlapping the contact member 210. Incorporated into the shaft 211 are molded spring fingers 208 having dimples 216 that rest in the detent recesses 212 formed in the circuit board 222. As the switch 200 is rotated, the fingers 208 apply spring pressure on the circuit board 222 or the recesses 212 therein, so that a mechanical detent mechanism is provided for providing operative positions for the switch 200.

The movable contacts 210 are keyed to the shaft 211 by keying feature 224 incorporated into the contact member hole 225, such that the wiper 210 moves as one with the shaft 211. Thus, the switch 200 is essentially complete, and is a fully-functioning switch. Assembly of the switch 200 is completed by placing the molded circuit board 222 into the housing 204 of the radio 100. Features are formed in the escutcheon plate such that when the knob 202 is attached to the switch shaft 211, the knob 202 and a sealing o-ring 218 form a water tight seal. If desired, the knob 202 can be made from an elastomeric material, such that the knob 202 itself also acts as a gasket, thereby eliminating the o-ring 218. A total of three parts are required to fabricate this switch 200, not including the knob 202. Therefore, the present invention provides a switch that requires less parts than are required for conventional switches.

What is claimed is:

1. A rotary switch, having a plurality of operating positions, comprising:

a molded base comprising a printed electric circuit, having a plurality of conductive paths, deposited on at least one surface of the base, for providing at least a first electrical contact;

a rotating contact member comprising at least a second electrical contact thereon for providing at least one connection between at least two of the conductive paths in the printed electric circuit, as the rotating contact member rotates;

detent means for providing the operating positions for the rotary switch, the detent means comprising first and second portions, the first portion and the base being molded as a one piece unit and the second portion and the rotating contact member being molded as a one piece unit; and attachment means for rotatably attaching the rotating contact member to the base.

2. The rotary switch of claim 1, wherein the rotating contact member comprises a metal brush.

3. The rotary switch of claim 1, wherein the first portion of the detent means comprises at least one projection integrally formed on the molded base, and the second portion comprises at least one recess formed in the rotating contact member, the recess corresponding to the projection for proving an operating position for the rotary switch.

4. The rotary switch of claim 1, wherein the first portion of the detent means comprises at least one recess formed on the molded base, and the second portion comprises at least one projection formed in the rotating contact member, the recess corresponding to the projection to provide an operating position for the rotary switch.

5. The rotary switch of claim 1 wherein the attachment means is a shaft integrally formed on the rotating contact member.

6. A radio with a rotary switch, having a plurality of operating positions, for controlling the radio, the rotary switch comprising:

a molded base comprising a printed electric circuit, having a plurality of conductive paths, deposited on at least one surface of the base, for providing at least a first electrical contact;

a rotating contact member comprising at least a second electrical contact thereon for providing at least one connection between at least two of the conductive paths in the printed electric circuit, as the rotating contact member rotates;

detent means for providing the operating positions for the rotary switch, the detent means comprising first and second portions, the first portion and the base being molded as a one piece unit and the second portion and the rotating contact member being molded as a one piece unit; and attachment means for rotatably attaching the rotating contact member to the base.

7. The radio of claim 6, wherein the rotating contact member comprises a metal brush.

8. The radio of claim 1, wherein the first portion of the detent means comprises at least one projection formed on the molded base, and the second portion comprises at least one recess integrally formed in the rotating contact member, the recess corresponding to the projection for proving an operating position for the rotary switch.

9. The radio of claim 6, wherein the first portion of the detent means comprises at least one recess formed on the molded base, and the second portion comprises at least one projection integrally formed in the rotating contact member, the recess corresponding to the projection to provide an operating position for the rotary switch.

10. A rotary switch, having a plurality of operating positions, comprising:

a molded base comprising a printed electric circuit, having a plurality of conductive paths, deposited on at least one surface of the base, for providing at least a first electrical contact;

a rotating contact member comprising at least a second electrical contact thereon for providing at least one connection between at least two of the conductive paths in the printed electric circuit, as the rotating contact member rotates;

a detent mechanism for providing the operating positions for the rotary switch, the detent mechanism comprising first and second portions, the first portion and the base being molded as a one piece unit and the second portion and the rotating contact member being molded as a one piece unit; and an attachment for rotatably attaching the rotating contact member to the base.

11. The rotary switch of claim 10, wherein the rotating contact member comprises a metal brush.

12. The rotary switch of claim 10, wherein the first portion of the detent mechanism comprises at least one projection integrally formed on the molded base, and the second portion comprises at least one recess integrally formed in the rotating contact member, the recess corresponding to the projection for proving an operating position for the rotary switch.

13. The rotary switch of claim 10, wherein the first portion of the detent mechanism comprises at least one recess formed on the molded base, and the second portion comprises at least one projection formed in the rotating contact member, the recess corresponding to the projection to provide an operating position for the rotary switch.

14. The rotary switch of claim 10 wherein the attachment is a shaft integrally formed on the rotating contact member.

* * * * *